US009792794B2

(12) United States Patent
Morris

(10) Patent No.: US 9,792,794 B2
(45) **Date of Patent: *Oct. 17, 2017**

(54) LIFE SAFETY DEVICE HAVING HIGH ACOUSTIC EFFICIENCY

(71) Applicant: Google Inc., Mountain View, CA (US)

(72) Inventor: Gary J. Morris, Morgantown, WV (US)

(73) Assignee: Google Inc., Mountain View, CA (US)

( * ) Notice: Subject to any disclaimer, the term of this patent is extended or adjusted under 35 U.S.C. 154(b) by 88 days.

This patent is subject to a terminal disclaimer.

(21) Appl. No.: 14/873,024

(22) Filed: Oct. 1, 2015

(65) Prior Publication Data

US 2016/0027274 A1 Jan. 28, 2016

Related U.S. Application Data

(63) Continuation of application No. 13/938,205, filed on Jul. 9, 2013, now Pat. No. 9,179,220.
(Continued)

(51) Int. Cl.
*H04R 1/20* (2006.01)
*G08B 17/10* (2006.01)
(Continued)

(52) U.S. Cl.
CPC ..... *G08B 17/10* (2013.01); *G08B 3/10* (2013.01); *G08B 17/113* (2013.01); *G10K 9/20* (2013.01); *G10K 11/04* (2013.01); *H04R 17/10* (2013.01)

(58) Field of Classification Search
CPC ... H04R 1/20; H04R 1/24; H04R 1/26; H04R 1/30; H04R 1/1016; H04R 1/345;
(Continued)

(56) References Cited

U.S. PATENT DOCUMENTS 1,836,222 A 12/1931 Bonine
2,746,558 A 5/1956 Levy
(Continued)

FOREIGN PATENT DOCUMENTS

CN 1707608 12/2005
EP 1881470 1/2008
(Continued)

OTHER PUBLICATIONS

The Darrow Company, "Smoke Alarms for Hard of Hearing Makes Low Frequency", 2014. Retrieved from the Internet at <http://www.loudenlow.com> on May 15, 2014, 4 pages.

*Primary Examiner* — Brian Ensey
(74) *Attorney, Agent, or Firm* — Kilpatrick Townsend & Stockton LLP

(57) ABSTRACT

Low frequency alarm tones emitted by life safety devices are more like to notify sleeping children and the elderly. Disclosed herein is a life safety device equipped with a novel, compact, quarter-wave, folded resonant cavity which significantly increases the low frequency (400-700 Hz square wave) acoustic efficiency of an audio output transducer when the folded resonant cavity is acoustically coupled to the transducer forming an audio output apparatus. The folded resonant cavity is comprised of undulating, annular, acoustic passages to significantly reduce the length of the resonant cavity, thereby permitting the audio output apparatus to fit within the housing of conventional size life safety devices such as, but not limited to, residential and commercial smoke alarms and carbon monoxide alarms. Battery powered embodiments of the audio output apparatus comprising a folded resonant cavity passed audibility tests for low frequency alarm tones in smoke alarms specified by UL217.

19 Claims, 6 Drawing Sheets

Related U.S. Application Data

(60) Provisional application No. 61/732,913, filed on Dec. 3, 2012, provisional application No. 61/669,695, filed on Jul. 10, 2012.

(51) Int. Cl.

| | |
|---|---|
| ***H04R 17/10*** | (2006.01) |
| ***G08B 3/10*** | (2006.01) |
| ***G10K 11/04*** | (2006.01) |
| ***G10K 9/20*** | (2006.01) |
| ***G08B 17/113*** | (2006.01) |

(58) Field of Classification Search

CPC ..... H04R 9/06; H04R 1/2826; H04R 1/2857; H04R 1/1075; H04R 1/342; H04R 1/2865; H04R 1/1023; H04R 5/02; H04S 1/002; G08B 17/00; G08B 17/10; G08B 17/07

USPC ..... 381/337–341; 181/175, 176, 187, 188, 181/193; 340/92, 540, 628

See application file for complete search history.

(56) References Cited

U.S. PATENT DOCUMENTS

| | | | |
|---|---|---|---|
| 3,687,221 | A | 8/1972 | Bonnard |
| 3,917,024 | A | 11/1975 | Kaiser |
| 3,923,124 | A | 12/1975 | Hancock |
| 4,282,520 | A | 8/1981 | Shipp et al. |
| 4,297,538 | A | 10/1981 | Massa |
| 4,399,427 | A | 8/1983 | Neese |
| 4,417,235 | A | 11/1983 | Del Grande |
| 4,571,915 | A | 2/1986 | Barman |
| 4,686,407 | A | 8/1987 | Ceperley |
| 4,700,177 | A | 10/1987 | Nakashima |
| 4,982,436 | A | 1/1991 | Cowan |
| 5,274,709 | A | 12/1993 | Koizumi |
| 5,317,876 | A | 6/1994 | Nakagawa et al. |
| 5,321,388 | A | 6/1994 | Biersach |
| 5,475,368 | A | 12/1995 | Collins et al. |
| 5,594,422 | A | 1/1997 | Huey et al. |
| 5,664,020 | A | 9/1997 | Goldfarb et al. |
| 5,675,312 | A | 10/1997 | Burnett |
| 5,710,395 | A | 1/1998 | Wilke |
| 5,751,827 | A | 5/1998 | Takahshi |
| 5,889,875 | A | 3/1999 | Caron et al. |
| 5,953,436 | A | 9/1999 | Zimmerman |
| 5,990,797 | A | 11/1999 | Zlotchenko et al. |
| 6,035,051 | A | 3/2000 | Sato |
| 6,356,643 | B2 | 3/2002 | Yamagishi et al. |
| 6,425,456 | B1 | 7/2002 | George |
| 6,573,833 | B1 | 6/2003 | Rosenthal |
| 6,646,548 | B2 | 11/2003 | Dornfeld |
| 6,648,098 | B2 | 11/2003 | Nichols |
| 6,973,994 | B2 | 12/2005 | Mackin |
| 7,051,835 | B2 | 5/2006 | Martikainen |
| 7,068,176 | B2 | 6/2006 | Black et al. |
| 7,284,638 | B1 | 10/2007 | Sahyoun |
| 7,528,701 | B2 | 5/2009 | Adelman |
| 7,605,687 | B2 | 10/2009 | Morris |
| 7,702,114 | B2 | 4/2010 | Aarts |
| 7,714,700 | B2 | 5/2010 | Morris |
| 7,956,764 | B2 | 6/2011 | Morris |
| 8,098,868 | B2 * | 1/2012 | Kim ..... H04M 1/0214 381/338 |
| 8,237,577 | B2 | 8/2012 | Albert et al. |
| 8,242,899 | B2 | 8/2012 | Albert et al. |
| 8,525,689 | B2 | 9/2013 | Smith et al. |
| 8,558,708 | B2 | 10/2013 | Albert et al. |
| 2003/0085813 | A1 | 5/2003 | Burnett et al. |
| 2004/0003961 | A1 | 1/2004 | Gunness |
| 2005/0128058 | A1 | 6/2005 | Oyagi |
| 2006/0029241 | A1 | 2/2006 | Graber |
| 2006/0045301 | A1 | 3/2006 | Jakubaitis |
| 2007/0084396 | A1 | 4/2007 | Cleckler et al. |
| 2008/0024314 | A1 | 1/2008 | Hill et al. |
| 2008/0197998 | A1 | 8/2008 | Campmans |
| 2008/0272895 | A1 | 11/2008 | Young et al. |
| 2008/0314680 | A1 | 12/2008 | Doneux et al. |
| 2009/0184830 | A1 | 7/2009 | Watabe et al. |
| 2011/0056763 | A1 | 3/2011 | Tanase et al. |
| 2011/0095896 | A1 | 4/2011 | Lewis et al. |
| 2011/0095900 | A1 | 4/2011 | Smith et al. |
| 2011/0193697 | A1 | 8/2011 | Albert et al. |
| 2013/0076511 | A1 | 3/2013 | Blanc et al. |
| 2013/0146390 | A1 | 6/2013 | Runciman |

FOREIGN PATENT DOCUMENTS

| | | |
|---|---|---|
| GB | 2478552 A | 9/2011 |
| JP | 2005141079 | 6/2005 |
| WO | 2009060420 | 5/2009 |

* cited by examiner

LIFE SAFETY DEVICE HAVING HIGH ACOUSTIC EFFICIENCY

CROSS REFERENCES TO RELATED PATENT APPLICATIONS

This application is a continuation of U.S. patent application Ser. No. 13/938,205 filed Jul. 9, 2013, which claims priority to: U.S. Provisional Application No. 61/732,913, filed Dec. 3, 2012 and U.S. Provisional Application No. 61/669,695, filed Jul. 10, 2012. This application is hereby incorporated by reference for all purposes.

FIELD OF INVENTION

This invention relates to life safety devices that emit low frequency alarm tones on the order, but not limited to, 520 Hz fundamental frequency when a sensor in the device senses an environmental condition such as but limited to smoke, fire, natural gas, propane, carbon monoxide, motion, intrusion, glass breakage, vibration, moisture, etc. A compact, folded resonant acoustic cavity is used so that the geometry of an audio output apparatus can fit within conventional size housing for the life safety device and so that the power is small to drive the audio output transducer acoustically coupled to the resonant cavity comprising the audio output apparatus.

BACKGROUND OF THE INVENTION

Research has shown that compared to high frequency alarm tones (on the order of 3 kHz), low frequency alarm tones on the order of a 520 Hz, fundamental frequency, square wave can be more effective in awakening children from sleep and can be better heard by people with high frequency hearing deficit which often accompanies advanced age or those exposed to loud sounds for extended periods of time. One of the problems in utilizing a such a low frequency (pitch) alarm tone is that it takes more electrical driving power for an audio output transducer to emit a low frequency alarm tone (for example ~520 Hz) than to emit a higher frequency alarm tone (for example 3 kHz) at comparable sound pressure levels interpreted as loudness by humans. This problem is compounded when a low frequency alarm tone is desired to be used in a life safety device such as a conventional environmental condition detector such as a smoke detector or carbon monoxide detector or a combination smoke and carbon monoxide detector, as non-limiting examples, since such detector unit components including the sound producing elements are typically contained within a housing a few inches tall (~2-3 inches thick in outside dimension) and approximately three to six inches in diameter or approximately square planform. Due to these geometric constraints (largely for a non-intrusive décor and aesthetics), it is difficult to use a normal, quarter wave, resonant cavity comprising a tube with one open end and one closed end (Helmholtz resonant cavity or resonator). Based on the theory of acoustics, the length of such a resonating cavity (resonator) should be on the order of one quarter of a wavelength of the fundamental frequency to obtain resonance which reinforces (amplifies) the sound output of an audio output transducer (for example a speaker or piezoelectric transducer) acoustically coupled to a resonant cavity. For example, for a fundamental frequency of 520 Hz, a quarter-wave, closed end, resonant cavity with an open opposite end would theoretically need to be approximately 6.5 inches long for air at standard sea level conditions where the speed of sound is approximately 1120 ft/sec. Practically however, allowing for end effects of the open end of the cavity, the length of such a quarter-wave, resonant cavity is on the order of 5 inches, still about twice the dimension of the thickness of the housing of a conventional environmental condition detector. Further, in order to get the requisite sound pressure level with conventional battery power used in environmental condition detectors (single 9V alkaline battery or 2-4 AA alkaline batteries for example), the audio output transducer needs to be on the order of at least 1.75 inches in diameter in one embodiment of the invention. Given this diameter along with a length on the order of 5 inches from the example above, it is easily determined that this size resonant cavity would occupy so much volume inside the housing of a life safety device configured as a conventional environmental condition detector that it would likely cause major issues with the omni-directional inlet airflow qualities required in smoke and carbon monoxide detectors for maximum sensitivity and/or also result in much larger housing dimensions than are conventional for such life safety devices. Therefore, while a resonant cavity is a very useful element to amplify the sound pressure output of an audio output transducer coupled to the resonant cavity forming an audio output apparatus, it is clear that a conventional, non-folded, quarter wave, resonant cavity is not as geometrically suitable for conventionally shaped and sized environmental condition detectors as a more compact quarter wave, resonant cavity would be for this application. It is noted that the current trend, in particular for smoke detectors and carbon monoxide detectors designs, is to have a smaller overall spatial profile to be less intrusive into the décor of residences and commercial installations.

SUMMARY OF THE INVENTION

In order to efficiently emit a low frequency, audible alarm tone when a potentially hazardous environmental condition is sensed, an audio output apparatus comprises an audio output transducer acoustically coupled to a folded resonant cavity in a compact geometry to fit within the housing of a life safety device. The folded resonant cavity comprises acoustic passages or paths such that sound waves generated by the audio output transducer traverse the acoustic paths and establish standing acoustic waves at the fundamental frequency (or integer multiple thereof) of the resonant cavity thereby reducing the acoustic impedance experienced by the audio output transducer. The reduction in acoustic impedance permits the audio output transducer to function in an optimally acoustic efficient manner in converting electrical power into acoustic power. A properly designed, quarter wave, folded, resonant cavity acoustically coupled to an audio output transducer with a fundamental resonant frequency matching that of the resonant cavity will significantly increase the acoustic efficiency of the audio output transducer coupled to the resonant cavity compared to the audio output transducer alone. Thus, the properly designed, folded, resonant cavity amplifies or reinforces the sound emitted into the ambient air by the audio output transducer and enhances the amount of electrical power converted to acoustic power. This is a tuned acoustic output apparatus for a specific tone frequency or harmonics thereof and is not designed to most effectively emit broad frequencies of sound. A frequency matched, folded, resonant cavity coupled to an audio output transducer produces significantly increases sound pressure level measured in dBA transmitted to the ambient surroundings compared to the audio output transducer alone with the same acoustic power input.

In at least one embodiment of the audio output apparatus of the life safety device, the audio output transducer is substantially hermetically sealed to a folded resonant cavity such that there is little to no air (gas) exchange or flow between the internal volume of the resonant cavity and the exterior of the cavity in order to maximize amplification of the sound pressure produced by the audio output apparatus. In such an embodiment, a substantially fixed mass of air (or other gas) within the resonant cavity (a non-Helmholtz resonant cavity or resonator) is maintained within the cavity bounded by the impervious walls of the cavity and the flexible diaphragm or other moving element of the coupled audio output transducer. The oscillating, flexible diaphragm in this configuration acts similar to a reciprocating piston cyclically compressing and expanding air in a piston-cylinder apparatus. The elasticity of the fixed mass of air within the resonant cavity is analogous to a mechanical spring. The use of the terms "substantially fixed mass of air", "substantially hermetically sealed", "substantially air-tight" and similar terms used herein, means that it is intended that the mass of air (gas) within the resonant cavity be captured, fixed, and separated from the ambient air surrounding the resonant cavity, however, minute leaks air leaks (no more than about 5% of the volume swept from null position to full amplitude displacement of the diaphragm of the audio output transducer) from the cavity resulting from normal manufacturing variations may be tolerated without loss of the intended function or performance. The novel synergistic design of the resonant cavity having a fixed, fundamental natural frequency matching (or very nearly matching) the fundamental resonant frequency of the coupled audio output transducer is an important feature to permit the emission of low frequency alarm tones on the order of 400 to 700 Hz powered by 9V, AA, or AAA batteries while maintaining a compact geometry to fit within conventional size life safety devices such as but not limited to residential or commercial smoke and carbon monoxide alarms. The proper design of the folded resonant cavity with a fixed mass of contained air within the resonant cavity is important to provide minimum acoustic impedance to the audio output transducer coupled to the resonator which translates into the maximum sound pressure level emitted by the audio output apparatus per input electrical power to the apparatus.

DETAILED DESCRIPTION

Figure 1:
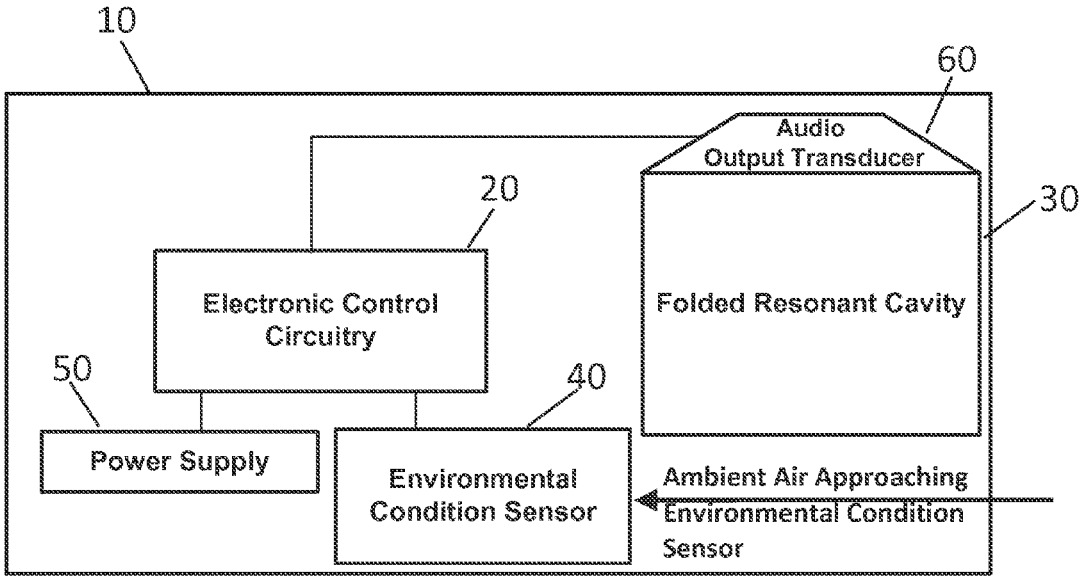
FIG. 1 is a block diagram of the life safety device with folded resonant cavity for low frequency alarm tones.

A life safety device with a folded acoustic resonant cavity for the amplification of low frequency alarm tones has been developed and is disclosed herein. FIG. 1 illustrates in a block diagram the components of such a life safety device configured in one embodiment as an environmental condition detector with a folded acoustic resonant cavity. The electronic control circuitry 20 comprises at least one ASIC in one embodiment and a programmable microprocessor in another embodiment. The electronic control circuitry 20 also comprises an audio amplifier connected to audio output transducer 60. The electronic control circuitry 20 manages the overall functions of the environmental condition detector as is well known in the art, such as determining when the environmental condition sensor 40 has sensed a potentially hazardous condition and sending an electronic audio signal to be output through an audio output transducer 60 as alarm tones when an environmental condition has been sensed. The programmable microprocesser (PICI 6F84A in one embodiment) is programmed, among other things, to output square wave signals to drive an audio amplifier (TDA7056B 5 W bridge tied load, mono-audio output amplifier in one embodiment). A step-up DC to DC switching regulator (LT1961 for example) is used in one embodiment to keep the voltage to the audio output transducer constant as battery voltage declines with time and/or use.

FIG. 1 also illustrates that the compact nature of the folded resonant cavity 30 permits the housing 10 of a conventional size and shape environmental condition detector (for example without limitation, smoke and/or carbon monoxide detector) to contain the resonant cavity 30 for producing low frequency alarm tones (on the order of 520 Hz fundamental frequency in one embodiment where "on the order of" is defined as within the range from 400 Hz to 700 Hz) while not significantly negatively affecting the ambient air flow approaching the environmental condition sensor 40. In various embodiments, the environmental condition sensor 40 may comprise a sensor for smoke, fire, carbon monoxide, heat, natural gas, propane gas, vibration, glass breakage, intrusion, or moisture. Some embodiments of the environmental condition sensor 40 may include more than one sensor such as a smoke sensor and a carbon monoxide sensor. It is noted that for smoke alarms and carbon monoxide alarms, holes or vents in the housing 10 located around its periphery permit ambient air to move into the environmental condition sensor 40 from any direction for maximum sensitivity and safety. Therefore, one novel advantage of the compact size of the folded, quarter wave, resonant cavity designs disclosed herein is the synergistic effect of using a compact, quarter wave, resonant cavity to reinforce (amplify) sound output from the audio output transducer 60 while safely fitting within a housing 10 approximately 2 to 3 inches tall (thick) and approximately 3-6 inches in diameter without degrading the directional sensitivity of the environmental condition sensor 40. The folded, acoustic, quarter wave, resonant cavity 30 operates on similar acoustic principles as a non-folded, quarter wave, resonant cavity, each resonant cavity type having one air particle displacement node region and one air particle displacement antinode region separated by approximately one quarter of the wavelength of the fundamental frequency of the sound wave being reinforced or amplified. Here an "air particle" means the molecules or atoms comprising the gas inside the resonant cavity. Acoustic waves are longitudinal wave. The nodes and antinodes described herein refer to particle displacement nodes. For folded resonant cavities described herein, the acoustic path between the node and antinode regions takes on an undulating geometry for at least part of this path as shown in FIGS. 2, 3, 4, 5 and 6. The antinode region and the node region are on opposite ends of the undulating acoustic path. Due to non-linearity of acoustic behavior in the folded resonant cavities resulting from the undulating, acoustic path as a result of the fold(s), viscous effects of narrow acoustic passages, and possible regions of increased air (gas) velocity in any locally narrowed regions in the undulating path between the node and antinode regions of the resonant cavity where the cross sectional area of the path may change, the length of the path between the node and antinode regions does not always exactly scale in a linear manner between folded, resonant cavities and non-folded, resonant cavities, which have straight acoustic paths and typically wide, acoustic passages. In theory, a single folded, quarter wave, acoustic resonant cavity is made to be approximately one-half of the outside longitudinal dimension of an unfolded quarter wave resonant cavity, a double folded, quarter wave, acoustic resonant cavity is made to approximately one-third of the outside longitudinal dimension as an unfolded, quarter wave, resonant cavity, and a triple folded, quarter wave, acoustic resonant cavity is made to be approximately one-quarter of the outside longitudinal dimension as an unfolded, quarter wave, resonant cavity, but the actual outside longitudinal dimensions of the folded, resonant cavities may vary slightly from theory due to acoustic non-linearity described above and/or due to finite thickness of the material (plastic in one embodiment) comprising the resonant cavities. Resonant cavities with more folds require a greater number of acoustic path forming, solid walls which displace air volume within the cavity, which in turn, require slightly larger external dimensions or cause increases in viscous losses due to reduced acoustic path width.

The power supply 50 shown in FIG. 1 is a battery power supply (9V alkaline, multiple AA alkaline, or multiple AAA alkaline as non-limiting examples), a wired alternating current power supply, a wired direct current power supply, or a wired power supply with a battery back-up. In one embodiment of the invention, the power supply 50 comprises a battery powered supply with a DC to DC step-up converter (switching regulator) to maintain the supply voltage to drive the audio output transducer 60 coupled to the folded resonant cavity 30 as the battery voltage drops over time and with use.

Figure 2:
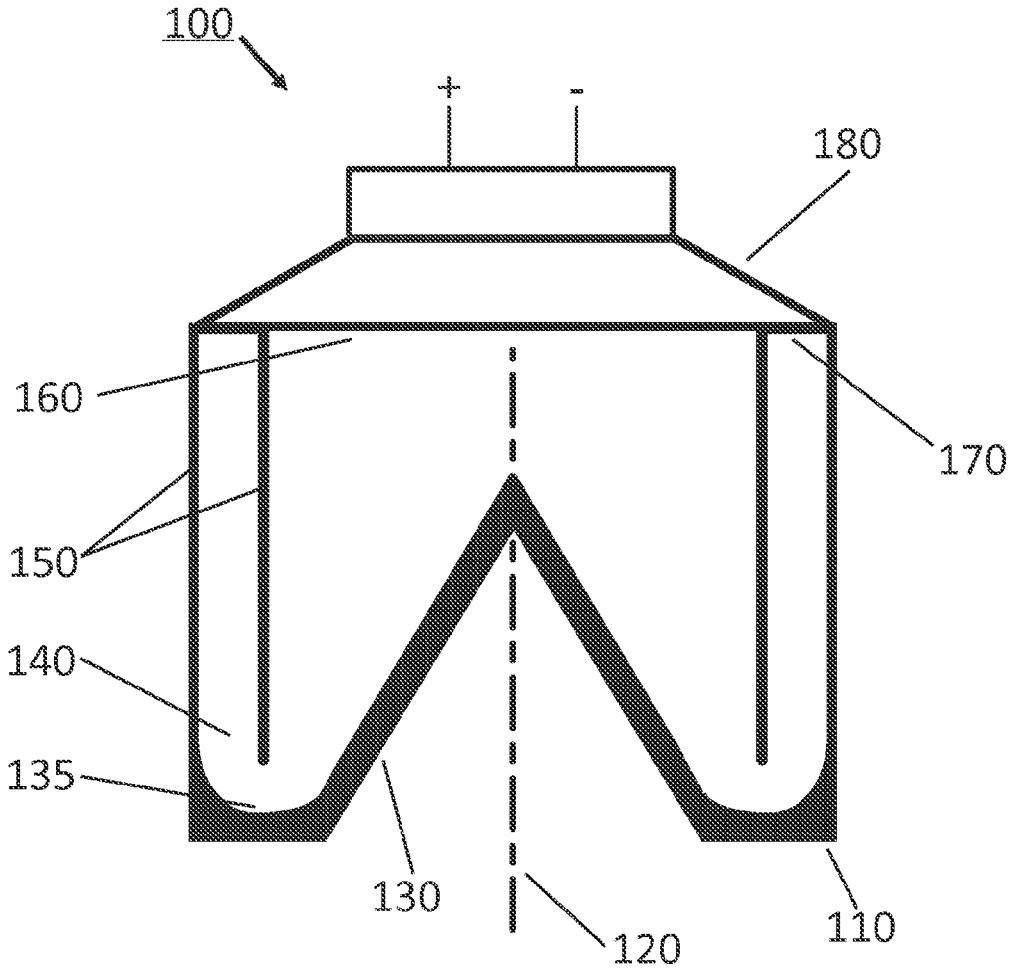
FIG. 2 shows, in two-dimensions, an axisymmetric embodiment of an audio output apparatus configured as a single folded, resonant cavity.

FIG. 2 shows, in two dimensions, the design of an audio output apparatus 100 configured as a single folded resonant cavity (single folded resonator) 110 acoustically coupled to an audio output transducer 180 (speaker, piezoelectric transducer, mechanical transducer, or other electrodynamic transducer). While the audio output transducer 180 is positioned outside of the folded resonant cavity 110 in FIG. 2, for an even more compact design, the audio output transducer may be inverted relative to its position shown and located all or partially within the antinode region 160 of the single folded resonant cavity 110. A central divider 130 inside the single folded resonant cavity 110 is positioned opposite the audio output transducer 180, symmetrically positioned about the centerline, longitudinal axis of revolution 120 of the single folded resonant cavity 110 in one embodiment with an air particle displacement antinode region 160 acoustically coupled to the audio output transducer 180. The central divider 130 is shown as a cone but can be manufactured as other various axisymmetric shapes (such as truncated cone shapes, bullet-nose shapes or parabolic bodies of revolution, etc.) without losing functionality. Allowing for the antinode region 160 to comprise a diameter on the order of at least one-half of the active surface diameter (speaker diaphragm diameter in one embodiment) of the audio output transducer 180 permits effective acoustic coupling of the antinode region 160 to the audio output transducer 180 in at least one embodiment. It is also noted that the central divider 130 need not be as tall or as wide at its base as shown in FIG. 2. The dimensions of the central divider 130 should be such that no significant strength, particle displacement nodes are present near the base of the central divider 130 by avoiding surfaces near the base of the central divider 130 which would reflect acoustic waves directly back to the audio output transducer 180 instead of directing the acoustic waves (pressure waves) into the annular, acoustic path 140. Acoustic path 140 serves as an annular, acoustic communication conduit (annular shaped passage) since the folded resonant cavity 110 is a body of revolution axisymmetric about the centerline, longitudinal axis of revolution 120 shown in FIG. 2. The annular node region 170 is where the acoustic wave generated by the audio output transducer 180 reaches its first and only significant strength, particle displacement node in a properly designed, quarter wave, single folded resonant cavity 110 and is thereby reflected back as a wave along the acoustic path 140 such that a standing acoustic wave is established in the acoustic path 140 and surrounding the central divider 130 for only specific frequencies such as the fundamental resonant frequency (or integer multiples thereof) of the single folded resonant cavity 110. The standing wave is turned approximately 180 degrees by starting from the antinode region 160, entering the acoustic path 140, following an undulating acoustic path, and ending at the node region 170.

When the audio output transducer 180 emits an acoustic wave into the antinode region 160 of the single folded resonant cavity 110, the acoustic wave travels towards the central divider 130 where the acoustic wave is directed into an acoustic path 140 bounded by cylindrical solid walls 150 whereby the spacing between the cylindrical walls is approximately 0.1 inches and the thickness of the cylindrical solid walls 150 is on the order of 0.05 inches in one non-limiting embodiment. The trough of the first, resonant cavity fold 135 at the base of the central divider 130 helps to direct the acoustic wave into the acoustic path 140, turning the wave almost 180 degrees without creating a significantly strong node in the vicinity of the trough of the first, resonant cavity fold (resonator fold) 135. The first resonant cavity fold 135 creates an undulation in the acoustic path 140. When the acoustic wave encounters the particle displacement node region 170 at the end of the acoustic path 140, the acoustic wave is reflected and reverses its direction of motion along the acoustic path 140 until the acoustic wave arrives at its starting position at the particle displacement antinode region 160. As the acoustic waves continue to be emitted from the audio output transducer 180 at the fundamental frequency (or integer multiple thereof) of the single folded resonant cavity 110, the subsequent newly generated, acoustic waves interact with reflected acoustic waves to establish a standing wave pattern within the acoustic path 140 and the central divider 130 region of the single folded resonant cavity 110 thereby significantly increasing the sound pressure level emitted from the audio output transducer 180 coupled to the single folded resonant cavity 110 compared to the sound pressure level emitted by the audio output transducer 180 alone.

The outside physical dimensions of the quarter wave, single folded resonant cavity 110 are 2.1 inches in diameter, and 2 inches long in one non-limiting embodiment. The diameter of the single folded resonant cavity 110 may vary depending on the size of the audio output transducer 180 coupled to single folded resonant cavity 110 as well as the thickness of the cylindrical solid walls 150 and the width of the acoustic path 140 used. When the width of the acoustic path 140 passage becomes much smaller than 0.1 inch, viscous losses within such thin passages can degrade the performance of the resonator. The length of the acoustic path 140 is on the order of 5 inches in one embodiment to produce a cavity fundamental resonant frequency of about 520 Hz.

Figure 3:
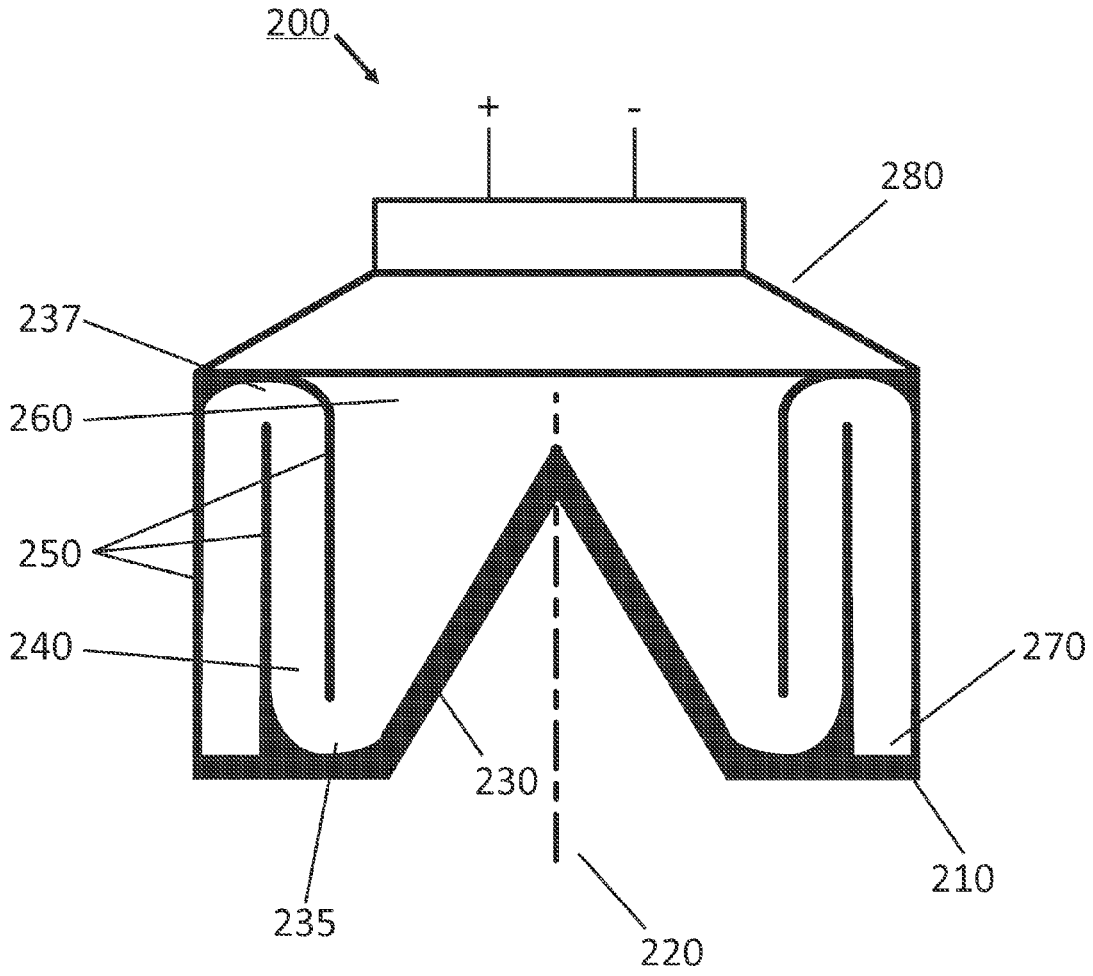
FIG. 3 shows, in two-dimensions, an axisymmetric embodiment of an audio output apparatus configured as a doubled folded, resonant cavity.

FIG. 3 shows, in two-dimensions, the design of an audio output apparatus 200 configured as a double folded, resonant cavity (double folded resonator) 210 acoustically coupled to an audio output transducer 280 (speaker, piezoelectric transducer, mechanical transducer, or other electrodynamic transducer). While the audio output transducer 280 is positioned outside of the double folded, resonant cavity 210 in FIG. 3, for an even more compact design, the audio output transducer may be inverted relative to its position shown and located all or partly within the antinode region 260 of the double folded, resonant cavity 210. A central divider 230 inside the double folded, resonant cavity 210 is positioned opposite the audio output transducer 280, symmetrically positioned about the centerline, longitudinal axis of revolution 220 of the double folded, resonant cavity 210 in one embodiment with an air particle displacement antinode region 260 acoustically coupled to the audio output transducer 280. The central divider 230 is shown as a cone but can be manufactured as various other axisymmetric shapes (such as truncated cone shapes, bullet-nose shapes or parabolic bodies of revolution, etc.) without losing functionality. Allowing for the antinode region 260 to comprise a cross-sectional area on the order of at least one-half of the active surface diameter (piezoelectric transducer diaphragm diameter in one non-limiting embodiment) of the audio output transducer 280 permits effective acoustic coupling of the antinode region 260 to the audio output transducer 280 in at least one embodiment. The central divider 230 need not be as tall or as wide at its base where the curved trough of the first, resonant cavity fold 235 connects to the central divider 230 as shown in FIG. 3. The dimensions of the central divider 230 should be such that no significant strength, particle displacement nodes are present near the base of the divider by avoiding surfaces near the base of the divider 230 which would reflect acoustic waves directly back to the audio output transducer 280 instead of directing the acoustic waves (pressure waves) into the annular acoustic path 240. Acoustic path 240 serves as an annular, acoustic communication conduit (annular shaped passage) since the double folded, resonant cavity 210 is a body of revolution axisymmetric about the centerline, longitudinal axis of revolution 220 shown in FIG. 3. The annular node region 270 is where the acoustic wave generated by the audio output transducer 280 reaches its first and only significant strength, particle displacement node in a properly designed, quarter wave, double folded, resonant cavity 210 and is thereby reflected back as a wave along the acoustic path 240 such that a standing acoustic wave is established in the acoustic path 240 and surrounding the central divider 230 for only specific frequencies such as the fundamental resonant frequency (or integer multiples thereof) of the double folded, resonant cavity 210. The standing wave is turned approximately 180 degrees twice by starting from the antinode region 260, entering the acoustic path 240 following an undulating acoustic path, and ending at the node region 270.

When the audio output transducer 280 emits an acoustic wave into the antinode region 260 of the double folded, resonant cavity 210, the acoustic wave travels towards the central divider 230 where the acoustic wave is directed into an undulating acoustic path 240 bounded by cylindrical solid walls 250 whereby the spacing between the cylindrical walls forming the undulating acoustic path 240 is approximately 0.1 inches in one non-limiting embodiment. The curved trough of the first, resonant cavity fold 235 at the base of the central divider 230 helps to direct the acoustic wave into the acoustic path 240, turning it almost 180 degrees without creating a significantly strong node in the vicinity of the curved trough of the first, resonant cavity fold 235. The acoustic wave next encounters a curved trough of the second, resonant cavity fold 237 where the wave is turned on the order of 180 degrees. The first, resonant cavity fold 235, and the second, resonant cavity fold 237 create undulations in the acoustic path 240. When the acoustic wave encounters the air particle displacement node region 270 (a solid wall perpendicular to the direction of motion of the acoustic wave) at the end of the acoustic path 240, the acoustic wave is reflected and reverses its direction of motion along the undulating, acoustic path 240 until the acoustic wave arrives at its starting position at the particle displacement antinode region 260. As the acoustic waves continue to be emitted from the audio output transducer 280 at the fundamental frequency (or integer multiple thereof) of the double folded, resonant cavity 210, the subsequent newly emitted acoustic waves interact with reflected acoustic waves to establish a standing wave pattern within the acoustic path 240 and the central divider 230 region of the double folded, resonant cavity 210 thereby significantly increasing the sound pressure level emitted from the audio output transducer 280 coupled to the double folded, resonant cavity 210 compared to the sound pressure level emitted by the audio output transducer 280 alone.

The outside physical dimensions of the quarter wave, double folded, resonant cavity 210 are 2.1 inches in diameter, and 1.4 inches long in one non-limiting embodiment. The diameter of the double folded, resonant cavity 210 may vary depending on the size of the audio output transducer 280 coupled to double folded, resonant cavity 210 as well as the thickness of the cylindrical solid walls 250 and the width of the acoustic path 240 used. When the width of the acoustic path 240 passage becomes much smaller than 0.1 inch, viscous losses within such thin passages can degrade the performance of the resonator. The length of the acoustic path 440 is on the order of 5 inches to produce a cavity fundamental resonant frequency of about 520 Hz.

Figure 4:
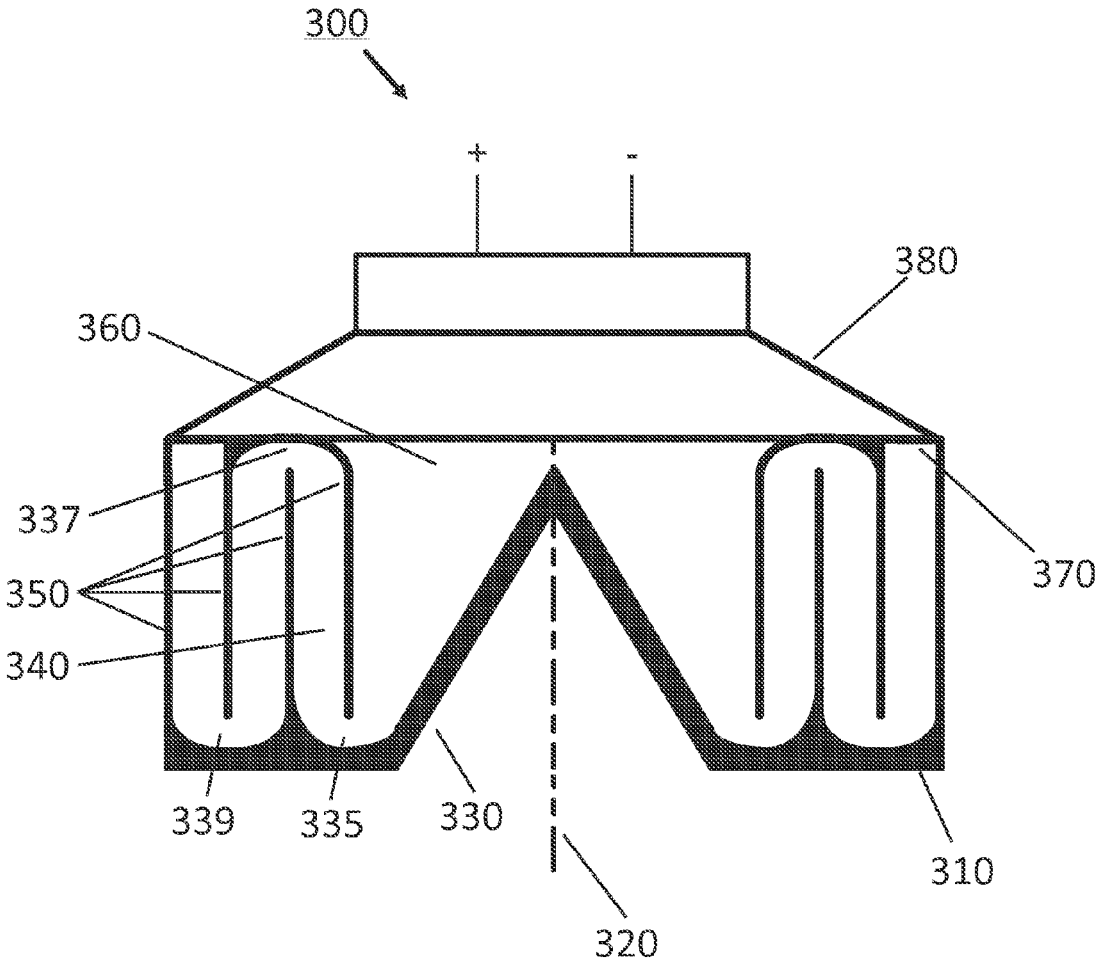
FIG. 4 shows, in two-dimensions, an axisymmetric embodiment of an audio output apparatus configured as a tripled folded, resonant cavity.

FIG. 4 shows, in two-dimensions, the design of an audio output apparatus 300 configured as a triple folded, resonant cavity (triple folded resonator) 310 acoustically coupled to an audio output transducer 380 (speaker, piezoelectric transducer, mechanical transducer, or other electrodynamic transducer). While the audio output transducer 380 is positioned outside of the triple folded, resonant cavity 310 in FIG. 4, for an even more compact design, the audio output transducer may be inverted relative to its position shown and located all or partly within the antinode region 360 of the triple folded, resonant cavity 310. A central divider 330 inside the triple folded, resonant cavity 310 is positioned opposite the audio output transducer 380 symmetrically positioned about the centerline, longitudinal axis of revolution 320 of the triple folded, resonant cavity 310 in one embodiment with an air particle displacement antinode region 360 acoustically coupled to the audio output transducer 380. The central divider 330 is shown as a cone but can be manufactured as various other axisymmetric shapes (such as truncated cone shapes, bullet-nose shapes or parabolic bodies of revolution, etc.) without losing functionality. Allowing for the antinode region 360 to comprise a cross-sectional area on the order of at least one-half of the active surface diameter (speaker diaphragm diameter in one non-limiting embodiment) of the audio output transducer 380 permits effective acoustic coupling of the antinode region 360 to the audio output transducer 380 in at least one embodiment. The central divider 330 need not be as tall or as wide at its base where the curved trough of the first, resonant cavity fold 335 connects to the central divider 330 as shown in FIG. 4. The dimensions of the central divider 330 should be such that no significant strength, particle displacement nodes are present near the base of the central divider 330 by avoiding surfaces near the base of the central divider 330 which would reflect acoustic waves directly back to the audio output transducer 380 instead of directing the acoustic waves (pressure waves) into the annular, acoustic path 340. Acoustic path 340 serves as an annular acoustic communication conduit (annular shaped passage) since the triple folded, resonant cavity 310 is a body of revolution axisymmetric about the centerline, longitudinal axis of revolution 320 shown in FIG. 4. The annular node region 370 is where the acoustic wave generated by the audio output transducer 380 reaches its first and only significant strength, particle displacement node in a properly designed folded quarter wave, triple folded, resonant cavity 310 and is thereby reflected back as a wave along the acoustic path 340 such that a standing acoustic wave is established in the acoustic path 340 and surrounding the central divider 330 for only specific frequencies such as the fundamental resonant frequency (or integer multiples thereof) of the triple folded, resonant cavity 310. The standing wave is turned approximately 180 degrees three times by starting from the antinode region 360, entering the acoustic path 340, following an undulating acoustic path, and ending at the node region 370.

When the audio output transducer 380 emits an acoustic wave into the antinode region 360 of the triple folded, resonant cavity 310, the acoustic wave travels towards the central divider 330 where the acoustic wave is directed into an undulating acoustic path 340 bounded by cylindrical solid walls 350 whereby the spacing between the cylindrical walls forming the undulating acoustic path 340 is approximately 0.1 inches in one non-limiting embodiment. The curved trough of the first, resonant cavity fold 335 at the base of the central divider 330 helps to direct the acoustic wave into the acoustic path 340 turning the wave almost 180 degrees without creating a significantly strong node in the vicinity of the curved trough of the first, resonant cavity fold 335. The acoustic wave next encounters a curved trough of the second, resonant cavity fold 337 where the wave is turned on the order of 180 degrees. The acoustic wave next encounters a curved trough of the third, resonant cavity fold 339 where the wave is turned on the order of 180 degrees. The first resonant cavity fold 335, the second, resonant cavity fold 337 and the third, resonant cavity fold 339 create undulations in the acoustic path 340. When the acoustic wave encounters the particle displacement node region 370 at the end of the acoustic path 340, the acoustic wave is reflected and reverses its direction of motion along the undulating, acoustic path 340 until the acoustic wave arrives at its starting position at the particle displacement antinode region 360. As the acoustic waves continue to be emitted from the audio output transducer 380 at the fundamental frequency (or integer multiple thereof) of the triple folded, resonant cavity 310, the subsequent newly emitted acoustic waves interact with reflected acoustic waves to establish a standing acoustic wave pattern within the acoustic path 340 and the central divider 330 region of the triple folded, resonant cavity 310 thereby significantly increasing the sound pressure level emitted from the audio output transducer 380 coupled to the triple folded, resonant cavity 310 compared to the sound pressure level emitted by the audio output transducer 380 alone.

The outside physical dimensions of the quarter wave, triple folded, resonant cavity 310 are 2.1 inches in diameter, and 1.0 inches tall in one non-limiting embodiment. The diameter of the tripled folded, resonant cavity 310 may vary depending on the size of the audio output transducer 380 coupled to tripled folded, resonant cavity 310 as well as the thickness of the cylindrical solid walls 350 and the width of the acoustic path 340 used. When the width of the acoustic path 340 passage becomes much smaller than 0.1 inch, viscous losses within such thin passages can degrade the performance of the resonator. The length of the acoustic path 340 is on the order of 5 inches to produce a cavity fundamental frequency of about 520 Hz.

Figure 5:
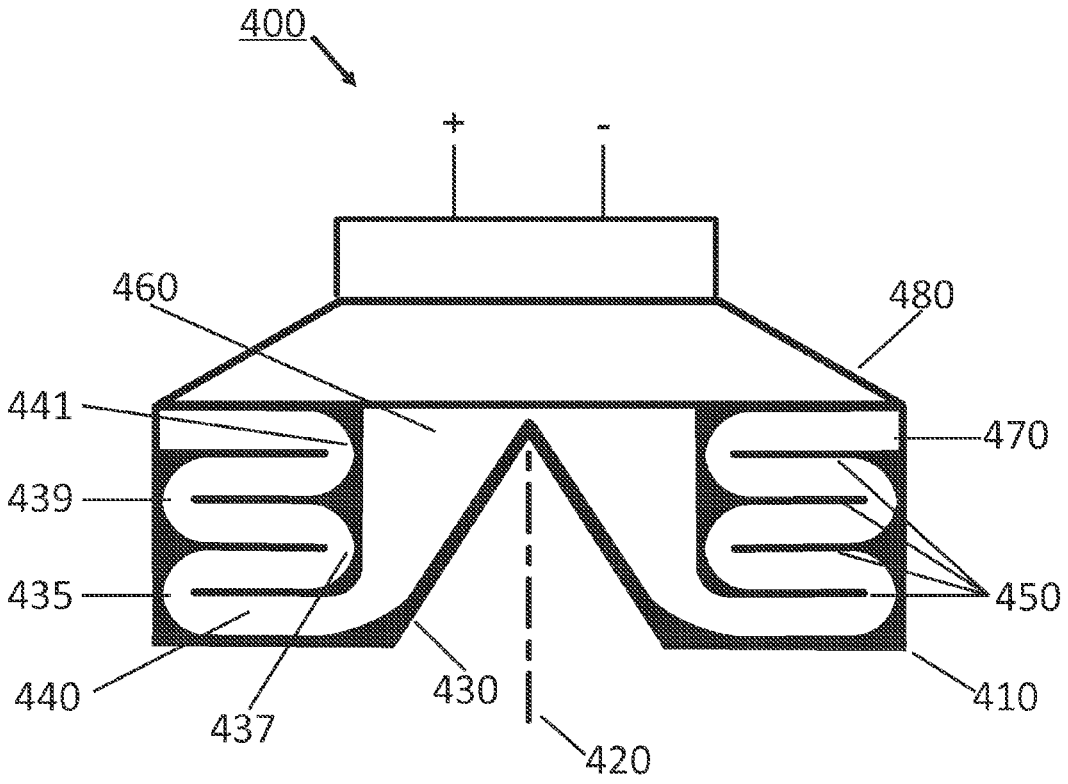
FIG. 5 shows, in two-dimensions, an axisymmetric embodiment of an audio output apparatus configured as a quad-folded, resonant cavity.

FIG. 5 shows, in two dimensions, the design of an audio output apparatus 400 configured as a quad-folded resonant cavity (quad-folded resonator) 410 acoustically coupled to an audio output transducer 480 (speaker, piezoelectric transducer, mechanical transducer, or other electrodynamic transducer). In this embodiment, the undulating, acoustic path 440 is primarily oriented perpendicular to the longitudinal centerline axis of revolution 420 (called the perpendicular configuration) whereas in the resonant cavities shown in FIGS. 2-4, the undulating, acoustic paths 140, 240, and 340 are primarily oriented parallel to the centerline, longitudinal axis of revolution 420 (called the parallel configuration). While the audio output transducer 480 is positioned outside of the quad-folded resonant cavity 410 in FIG. 5, for an even more compact design, the audio output transducer may be inverted relative to its position shown and located all or partly within the antinode region 460 of the quad-folded resonant cavity 410. A central divider 430 inside the quad-folded resonant cavity 410 is positioned opposite the audio output transducer 480 symmetrically positioned about the, centerline, longitudinal axis of revolution 420 of the quad-folded resonant cavity 410 in one embodiment with an air particle displacement antinode region 460 acoustically coupled to the audio output transducer 480. The central divider 430 is shown as a cone but can be manufactured as various other axisymmetric shapes (such as truncated cone shapes, bullet-nose shapes or parabolic bodies of revolution, etc.) without losing functionality. Allowing for the antinode region 460 to comprise a cross-sectional area on the order of at least one-half of the active surface diameter (speaker diaphragm diameter in one non-limiting embodiment) of the audio output transducer 480 permits effective acoustic coupling of the antinode region 460 to the audio output transducer 480 in at least one embodiment. The central divider 430 need not be as tall or as wide at its base as shown in FIG. 5. The dimensions of the central divider 430 should be such that no significant strength, particle displacement nodes are present near the base of the central divider 430 by avoiding surfaces near the base of the central divider 430 which would reflect acoustic waves directly back to the audio output transducer 480 instead of directing the acoustic waves (pressure waves) into the annular acoustic path 440. Acoustic path 440 serves as an acoustic communication passage between the air particle displacement antinode region 460 and the air particle displacement node region 470. The node region 470 is where the acoustic wave generated by the audio output transducer 480 reaches its first and only significant strength, particle displacement node in a properly designed folded quarter wave, quad-folded resonant cavity 410 and is thereby reflected back as a wave along the acoustic path 440 such that a standing acoustic wave is established in the acoustic path 440 and surrounding the central divider 430 for only specific frequencies such as the fundamental resonant frequency (or integer multiples thereof) of the quad-folded resonant cavity 410. The standing wave is turned approximately 180 degrees by extending from the central region of the quad-folded, resonant cavity 410 and by traversing the acoustic path 440 forming an undulating acoustic path.

When the audio output transducer 480 emits an acoustic wave into the antinode region 460 of the quad-folded resonant cavity 410, the acoustic wave travels towards the central divider 430 where the acoustic wave is directed into an undulating acoustic path 440 bounded by solid walls 450 whereby the spacing between the walls forming the undulating acoustic path 440 is approximately 0.1 inches in one non-limiting embodiment. The curved trough of the first, resonant cavity fold 435 turns an acoustic wave emitted from the audio output transducer 480 approximately 180 degrees. The acoustic wave next encounters a curved trough of the second, resonant cavity fold 437 where the wave is again turned on the order of 180 degrees. The acoustic wave next encounters a curved trough of the third, resonant cavity fold 439 where the wave is turned on the order of 180 degrees. The acoustic wave next encounters a curved trough of the fourth resonant cavity fold 441 where the wave is once again turned on the order of 180 degrees. The resonant cavity folds, 435, 437, 439, and 441 create undulations in the acoustic path 440. When the acoustic wave encounters the particle displacement node region 470 at the end of the acoustic path 440, the acoustic wave is reflected and reverses its direction of motion along the undulating, acoustic path 440 until the acoustic wave arrives at its starting position at the particle displacement antinode region 460. As the acoustic waves continue to be emitted from the audio output transducer 480 at the fundamental frequency (or integer multiple thereof) of the quad-folded resonant cavity 410, the subsequent newly emitted acoustic waves interact with reflected acoustic waves to establish a standing acoustic wave pattern within the acoustic path 440 and the central divider 430 region of the quad-folded resonant cavity 410 thereby significantly increasing the sound pressure level emitted from the audio output transducer 480 coupled to the quad-folded resonant cavity 410 compared to the sound pressure level emitted by the audio output transducer 480 alone.

The outside physical dimensions of the quarter wave, quad-folded resonant cavity 410 are 2.5 inches in diameter, and 0.85 inches tall in one non-limiting embodiment. The diameter and length (height) of the quad-folded resonant cavity 410 may vary depending on the size of the audio output transducer 480 coupled to the quad-folded resonant cavity 410 as well as the thickness of the solid walls 450 and the width of the acoustic path 440 used. When the width of the acoustic path 440 passage becomes much smaller than 0.1 inch, viscous losses within such thin passages can degrade the performance of the resonant cavity. The length of the acoustic path 440 is on the order of 5 inches to produce a cavity fundamental frequency of about 520 Hz.

For all of the embodiments disclosed herein, a significant, synergistic, acoustic effect is created when the natural frequency of the audio output transducer matches a natural frequency of the folded resonant cavity. At that operation point, optimum sound pressure level and sound power are emitted from the audio output apparatus for a minimum power input to the audio output transducer at very specific frequencies (fundamental natural frequency and harmonics of the folded resonant cavity). This minimum power input with maximum sound pressure level output has great utility for battery operated, life safety devices such as, but not limited to, residential smoke alarms and carbon monoxide alarms. One of the novel aspects of the embodiments of the instant invention is that for very specific acoustic frequencies, a properly designed audio output apparatus 100 will provide the optimum cavity performance index (CPI) of sound pressure level output per power input per volume (in dBA/W-cm$^3$) of the resonant cavity producing low frequency alarm tones on the order of 400-700 Hz. Here, the sound pressure level is measured in dBA at a distance of 10 ft (~3.05 m) in an anechoic chamber, the power input is the electrical power in watts (normally a square waveform input signal with a ~50% duty cycle) driving the audio output transducer coupled to the folded resonant cavity and the volume is the external geometry volume in cm$^3$ of the body of the resonant cavity. The larger the numerical value of this CPI is for the audio output apparatus disclosed herein or other audio output apparatuses, the better the audio output apparatus is for use in conventional size life safety devices such as, but not limited to, smoke alarms and carbon monoxide alarms. The larger the numerical value of the CPI is for an audio output apparatus, the better the apparatus is suited for simultaneously satisfying the important two parameters of compactness and power efficiency for life safety devices which need to be as small as possible and output a low frequency alarm tone as energy efficiently as possible when a potentially hazardous condition is sensed. For one embodiment, the acoustic performance index was found to 2.67 dBA/(W-cm$^3$).

In other non-limiting embodiments of the invention, as additional resonant cavity folds are added, the diameters of the antinode regions 160, 260, and 360 become increasing smaller in internal diameter to accompany the additional resonant cavity folds while the outer diameter of the folded resonators 110, 210, and 310 remain approximately constant. Alternatively, in other embodiments, the diameters of the antinode regions 160, 260, and 360 remain constant as resonant cavity folds are added while the outer diameter of the folded resonators 110, 210, and 310 increases. Other embodiments, not shown but operating on the same acoustic concepts, include more than four resonant cavity folds and remain within the scope of this invention. In general, resonant cavities with more than one resonant cavity fold are called multi-folded resonant cavities herein.

In selected prototypes of the various non-limiting embodiments of the invention, a nominal 3-watt, 2.25 inch (57 mm) diameter speaker (CUI GF0573 in one embodiment) is substantially hermetically and acoustically coupled to the anitnode regions 160, 260, 360, and 460 of the folded resonant cavities 110, 210, 310 and 410, respectively, to produce sound pressure levels significantly higher than 85 dBA measured at a distance of 10 feet inside an anechoic chamber while operating under battery power. In one embodiment, a ring shaped flange manufactured into or otherwise affixed to the folded resonant cavity facilitates a secure and substantially, air-tight slip fit coupling of the audio output transducer 180, 280, 380, and 480 to the antinode region of the resonant cavities 110, 210, 310, and 410, respectively. A commercially available sealant may be used at the flange to further enhance and secure the seal between the audio output transducers 180, 280, 380, and 480 and the resonant cavities 110, 210, 310, and 410, respectively, in some embodiments as needed. Alternatively, in another embodiment, a commercially available sealant may be used to seal the outer edge of the audio output transducer 180, 280, 380, and 480 to the top face 375 (FIG. 5) of the folded resonant cavities 110, 210, 310, and 410, respectively, with the use of a flange.

Figure 6:
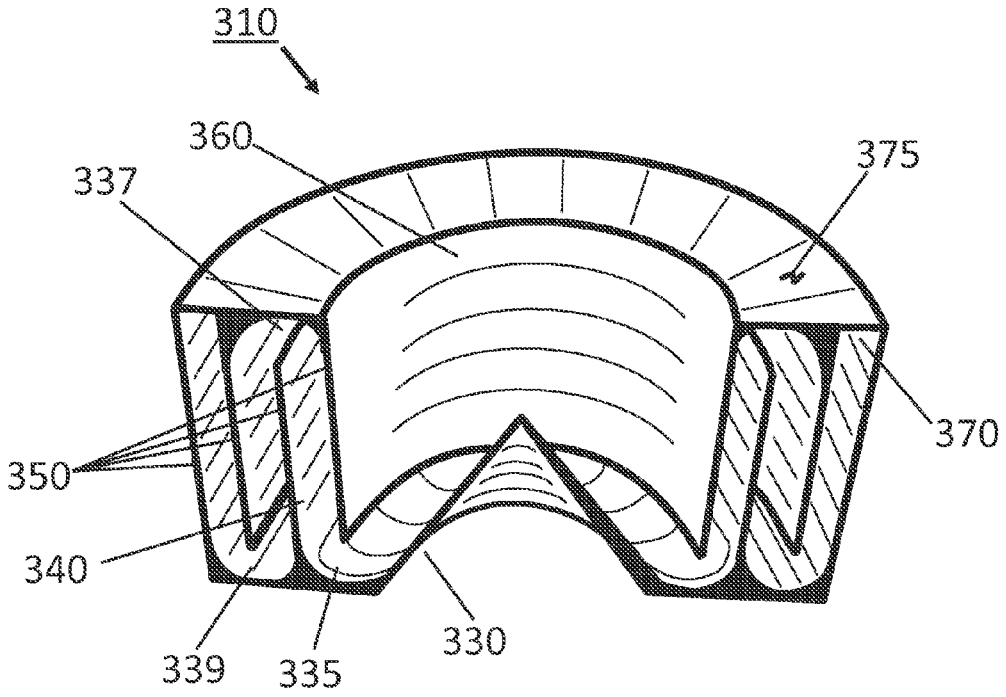
FIG. 6 shows a section view of a triple folded, resonant cavity.

FIG. 6 shows a side view of a half-section of the triple folded, resonant cavity 310. When an audio output transducer 380 is acoustically coupled to the antinode region 360 and is emitting a periodic acoustic wave on the order of a natural frequency of the triple folded, resonant cavity 310, a standing acoustic wave is established within the undulating acoustic passage 340 and the antinode region 360 whereby the standing wave reinforces the sound amplitude of the audio output transducer 380. The side of the diaphragm of audio output transducer 380 acoustically coupled to the ambient air (opposite side of the diaphragm acoustically coupled to the resonant cavity) emits a significant portion of the acoustic power emitted by the audio output apparatus 310. FIG. 6 serves as an exemplary half-section view of the folded resonant cavities presented herein, and it is understood that the single folded resonant cavity 110 and the double folded, resonant cavity 210 operate on the same physical principles with a reduced number of resonant cavity folds compared to the triple folded, resonant cavity 310 shown in FIG. 6. Folded resonant cavities 110 and 210 have very similar half-section views as the triple folded, resonant cavity 310 consistent with their respective two-dimensional drawings shown in FIGS. 2 and 3 respectively. Typically, as the number of resonant cavity folds increase, the longitudinal dimension (length) of the folded resonator cavities decreases for a fixed, fundamental resonant frequency of the cavities. A side view of the half section of the quad-folded resonant cavity 410 is not shown, but the cavity is an axisymmetric body of revolution about the centerline, longitudinal axis of revolution 420. Changing the number of resonant cavity folds in the perpendicular configuration of the quad-folded resonant cavity 410 will change the longitudinal length of the resonant cavity if the spacing between the solid walls 450 remains constant. This is true for other perpendicular configuration, resonant cavities with a different number of resonant cavity folds.

Tests of the folded resonant cavities coupled to an audio transducer amplified the sound pressure level by as much as 10 dBA compared to the audio transducer alone when driven with a 520 Hz symmetric square wave.

A prototype of the audio output apparatus 300 was tested by an independently recognized, life safety, testing laboratory in accordance with the UL217 standards for smoke alarms emitting low frequency alarm tones. The tests were conducted using single 9V alkaline battery power and passed the UL217 section 65.5 for audibility testing of low frequency alarms.

The various embodiments described above are merely descriptive and are in no way intended to limit the scope of the invention. Modification will become obvious to those skilled in the art in light of the detailed description above, and such modifications are intended to fall within the scope of the appended claims. It is to be understood that no limitation with respect to the specific apparatus illustrated, physical dimensions, or test results disclosed herein are intended or should be inferred.

I claim:

1. A life safety device having an audio output apparatus that emits a low frequency alarm tone, the audio output apparatus comprising:

an audio output transducer that produces the low frequency alarm tone on the order of 520 Hz in fundamental frequency;

a resonant cavity that comprises an undulating, acoustic path, wherein:

the audio output transducer is acoustically coupled to the resonant cavity and the resonant cavity amplifies an audible, low frequency tone emitted into ambient surroundings; and the fundamental resonant frequency of the resonant cavity matches the fundamental frequency of the low frequency alarm tone.

2. The life safety device having the audio output apparatus of claim 1, wherein the life safety device is powered by only one or more batteries.

3. The life safety device having the audio output apparatus of claim 1, wherein the resonant cavity is folded.

4. The life safety device having the audio output apparatus of claim 3, wherein the resonant cavity comprises a plurality of folds.

5. The life safety device having the audio output apparatus of claim 1, wherein an environmental condition sensor and the audio output apparatus are located on-board the life safety device.

6. The life safety device having the audio output apparatus of claim 1, further comprising electronic control circuitry that outputs a square wave as an electronic audio signal to the audio output transducer.

7. The life safety device having the audio output apparatus of claim 1, wherein the audio output transducer is selected from the group consisting of: a piezoelectric transducer and a speaker.

8. A life safety device that emits a low frequency alarm tone, the life saving device comprising:

a housing;

an audio output transducer;

a resonant cavity, wherein:

the audio output transducer is acoustically coupled to the resonant cavity;

the resonant cavity increases the sound pressure level emitted by the audio output transducer on the order of 10 dBA when the audio output transducer is driven by a signal at a designated frequency on the order of 520 Hz in fundamental frequency; and the fundamental resonant frequency of the resonant cavity matches the designated frequency.

9. The life safety device of claim 8, wherein the life safety device is powered by only one or more batteries.

10. The life safety device of claim 8, further comprising an environmental condition sensor, wherein the environmental condition sensor is located within the housing.

11. The life safety device of claim 8, wherein an electronic audio signal used to drive the audio output transducer is a square wave.

12. The life safety device of claim 8, wherein the resonant cavity comprises one or more folds.

13. The life safety device of claim 8, wherein the audio output transducer, electronic control circuitry, and the resonant cavity are located within the housing, and the housing has a volume of between 14.2 cubic inches and 84.8 cubic inches.

14. A smoke and carbon monoxide detector comprising:

a housing;

electronic control circuitry within the housing;

a smoke sensor within the housing;

a carbon monoxide sensor within the housing;

an audio output transducer, located within the housing, wherein the electronic control circuitry sends an electronic audio signal to the audio output transducer when the smoke sensor, carbon monoxide sensor, or both sense a hazardous environmental condition; and a resonant cavity, located within the housing, filled with a substantially fixed and contained mass of air, the resonant cavity being acoustically coupled with the audio output transducer, wherein:

the resonant cavity amplifies an audible, low frequency tone emitted by the audio output transducer;

the resonant cavity comprises an acoustic path created by at least one resonant cavity fold; and the low frequency tone emitted by the audio output transducer and the fundamental resonant frequency of the folded, resonant cavity match.

15. The smoke and carbon monoxide detector of claim 14, further comprising a power supply that receives power from only one or more batteries.

16. The smoke and carbon monoxide detector of claim 14, wherein the housing has a volume of between 14.2 cubic inches and 84.8 cubic inches.

17. The smoke and carbon monoxide detector of claim 14, wherein the low frequency tone emitted by the audio output transducer is a square wave with a fundamental frequency between 400 Hz and 700 Hz.

18. The life safety device having the audio output apparatus of claim 1, wherein the acoustic performance index of the resonant cavity is on the order of 2.67 dbA/W-$cm^3$.

19. The life safety device of claim 8, wherein the acoustic performance index of the resonant cavity is on the order of 2.67 dbA/W-$cm^3$.

* * * * *